US010317850B2

(12) United States Patent
Matsue

(10) Patent No.: US 10,317,850 B2
(45) Date of Patent: Jun. 11, 2019

(54) POSITIONING APPARATUS, ELECTRONIC TIMEPIECE, POSITIONING CONTROL METHOD AND RECORDING MEDIUM

(71) Applicant: CASIO COMPUTER CO., LTD., Tokyo (JP)

(72) Inventor: Takeshi Matsue, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/660,055

(22) Filed: Jul. 26, 2017

(65) Prior Publication Data

US 2018/0074461 A1 Mar. 15, 2018

(30) Foreign Application Priority Data

Sep. 15, 2016 (JP) ..... 2016-180148

(51) Int. Cl.

| | |
|---|---|
| ***G04G 3/04*** | (2006.01) |
| ***G04G 19/12*** | (2006.01) |
| ***G04G 99/00*** | (2010.01) |
| ***G04R 20/02*** | (2013.01) |
| ***G04R 40/00*** | (2013.01) |

(52) U.S. Cl.

CPC ..... *G04R 20/02* (2013.01); *G04G 3/04* (2013.01); *G04G 19/12* (2013.01); *G04G 99/00* (2013.01); *G04R 40/00* (2013.01)

(58) Field of Classification Search

CPC ..... G04G 19/12; G04G 3/04; G04R 20/02; G04R 20/04; G04R 40/00

See application file for complete search history.

(56) References Cited

U.S. PATENT DOCUMENTS

| | | | | |
|---|---|---|---|---|
| 5,893,044 | A * | 4/1999 | King | G01S 19/24 342/357.43 |
| 7,084,810 | B2 * | 8/2006 | Kitatani | G01S 19/23 342/357.62 |
| 7,236,810 | B1 * | 6/2007 | Underbrink | H04W 52/029 455/574 |
| 7,500,125 | B2 * | 3/2009 | Yasumoto | G01S 19/23 342/357.62 |
| 8,446,223 | B2 * | 5/2013 | Gronenneyer | G01S 19/23 331/176 |
| 8,901,983 | B1 * | 12/2014 | Ruffieux | G04G 3/022 327/262 |

(Continued)

FOREIGN PATENT DOCUMENTS

JP 2012-182538 A 9/2012

*Primary Examiner* — Daniel P Wicklund

(74) *Attorney, Agent, or Firm* — Scully Scott Murphy & Presser

(57) ABSTRACT

A positioning apparatus includes the following. A first oscillator outputs a clock signal. A second oscillator outputs a clock signal which is more accurate than the first oscillator. A receiver receives a radio wave from a positioning satellite. A positioning controller calculates a present position based on positioning information calculated from the received radio wave. The positioning controller controls switching of a supply source of the clock signal supplied to the receiver and the positioning controller between the first oscillator and the second oscillator depending on a reception status of the radio wave from the positioning satellite by the receiver.

20 Claims, 3 Drawing Sheets

(56) References Cited

U.S. PATENT DOCUMENTS

| | | | | |
|---|---|---|---|---|
| 2004/0225439 | A1* | 11/2004 | Gronemeyer | G04G 19/12 701/469 |
| 2010/0214165 | A1* | 8/2010 | Baba | G01S 19/19 342/357.25 |
| 2010/0254225 | A1* | 10/2010 | Schweitzer, III | G04R 40/06 368/47 |
| 2011/0295462 | A1* | 12/2011 | Park | G04R 20/06 701/36 |
| 2014/0003199 | A1* | 1/2014 | Dougan | G04G 7/00 368/46 |
| 2015/0097726 | A1* | 4/2015 | Babitch | G01S 19/235 342/357.62 |

* cited by examiner

POSITIONING APPARATUS, ELECTRONIC TIMEPIECE, POSITIONING CONTROL METHOD AND RECORDING MEDIUM

BACKGROUND OF THE INVENTION

1. Field of the Invention

The present invention relates to a positioning apparatus, an electronic timepiece, a positioning control method, and a recording medium.

2. Description of the Related Art

There is a multi-functional electronic timepiece which is able to perform various functions in addition to displaying the time. In such electronic timepieces, operation is performed based on a clock signal generated by an oscillating circuit. When a function in which controlling timing is important is performed, accuracy of such clock signal becomes important. Specifically, the oscillating frequency easily changes according to the temperature conditions. In view of the above, there are conventionally known oscillators including a temperature compensating circuit and oscillators including a configuration to suppress change in temperature.

Functions among the various functions in the electronic timepiece include calculating the accurate date and time and the present position by receiving radio waves from a positioning satellite and transmitting and receiving various types of data using various communication standards such as Bluetooth (registered trademark) or WLAN (wireless LAN). When communication is performed, clock frequencies, operation frequencies of various units operating based on clock frequencies, and frequencies which are constant multiplications of the above overlap with the reception frequencies and noise occurs. As a result, the reception sensitivity decreases. In view of the above, there is a technique which changes the clock signal frequencies and the operation frequencies when the radio waves are received so that the constant multiplications of the above do not overlap with the reception frequencies. For example, Japanese Patent Application Laid-Open Publication No. 2012-182538 discloses setting a plurality of operation frequencies in advance, and when the reception sensitivity decreases in one operation frequency, the operation frequency is changed to a different operation frequency to avoid overlapping. Overlapping of frequencies due to influence of change in oscillating frequencies because of temperature change can also be avoided.

However, to constantly use an oscillator with high accuracy in a positioning apparatus and an electronic timepiece means to perform operation more than necessary to maintain accuracy. With this, electric power consumption increases and efficiency worsens. On the other hand, if the accuracy is simply reduced, the reception sensitivity reduces. Then, operation to acquire radio waves needs to be frequently performed and this consumes large amounts of electric power. Consequently, in this case also the efficiency worsens.

SUMMARY OF THE INVENTION

A positioning apparatus, an electronic timepiece, a positioning control method, and a recording medium which are able to efficiently perform positioning operations are disclosed.

According to one embodiment, there is provided a positioning apparatus including: a first oscillator which outputs a clock signal; a second oscillator which outputs a clock signal which is more accurate than the first oscillator; a receiver which receives a radio wave from a positioning satellite; and a positioning controller which calculates a present position based on positioning information calculated from the received radio wave, wherein, the positioning controller controls switching of a supply source of the clock signal supplied to the receiver and the positioning controller between the first oscillator and the second oscillator depending on a reception status of the radio wave from the positioning satellite by the receiver.

DETAILED DESCRIPTION OF THE PREFERRED EMBODIMENTS

A preferred embodiment is described with reference to the drawings.

Figure 1:
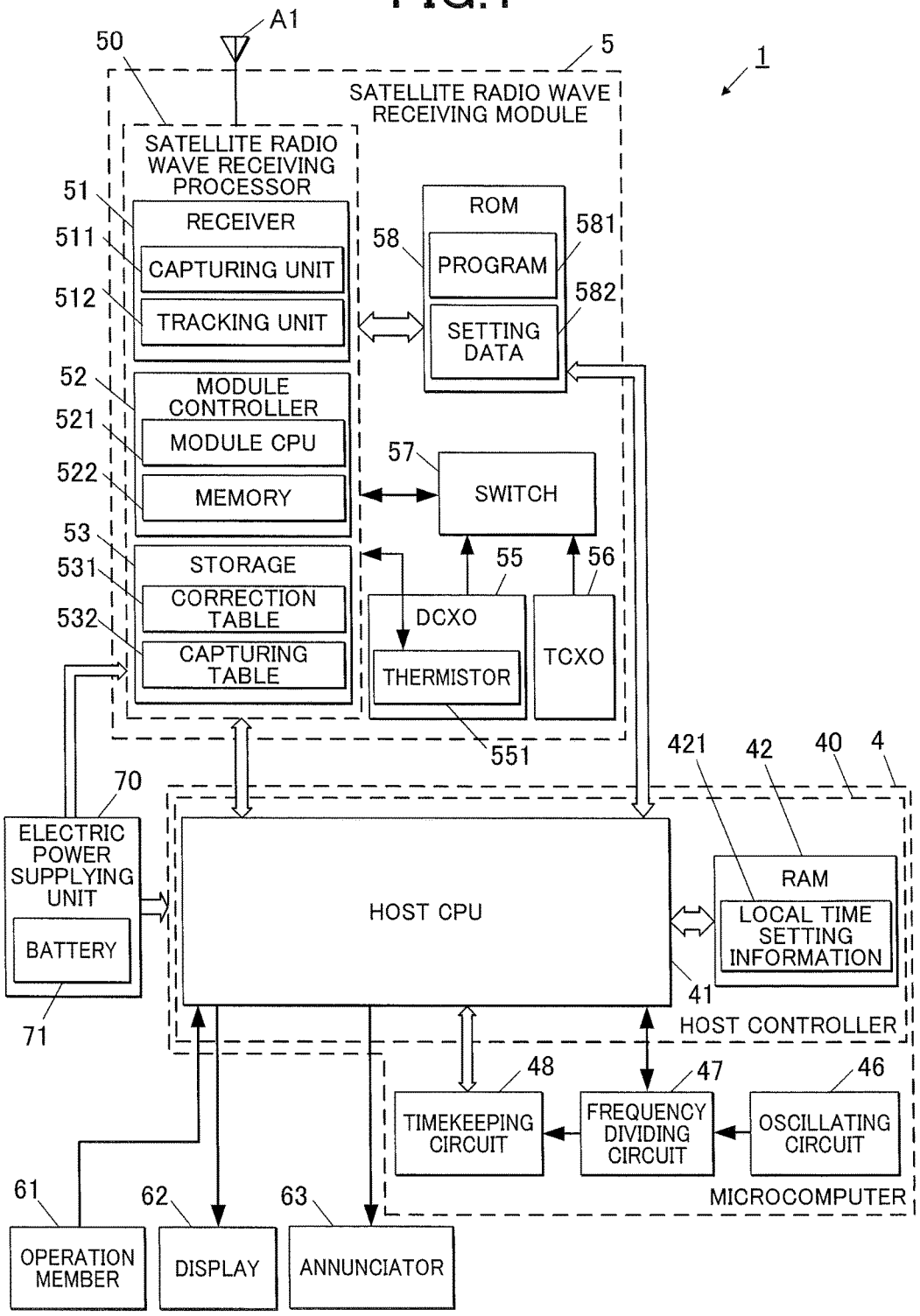
FIG. 1 is a block diagram showing a functional configuration of an electronic timepiece according to an embodiment of the present invention.

FIG. 1 is a block diagram showing a functional configuration of an electronic timepiece 1 which is an embodiment of an electronic timepiece of the present invention, the electronic timepiece 1 including a satellite radio wave receiving module 5 which is an embodiment of the positioning apparatus of the present invention.

The electronic timepiece 1 according to the present embodiment is a watch including a band, and the watch is attached to an arm of a user by using the band.

The electronic timepiece 1 includes, a microcomputer 4, a satellite radio wave receiving module 5, an antenna A1, an operation member 61, a display 62, an annunciator 63, and an electric power supplying unit 70.

The microcomputer 4 includes a host controller 40 (a timekeeping controller), an oscillating circuit 46, a frequency dividing circuit 47, and a timekeeping circuit 48 (timekeeping unit).

The host controller 40 includes a host CPU 41 (Central Processing Unit) and a RAM 42 (Random Access Memory).

The host CPU 41 is a processor which performs various calculating processes. The calculating process performed by the host CPU 41 is mainly a process regarding counting and displaying the date/time as the clock of the electronic timepiece 1. This is performed continuously and repeatedly for a long period of time with a low load.

The RAM 42 provides a work memory space in the host CPU 41 to store temporary data and setting data. The setting data includes local time setting information 421 which is the setting of time-zones and summer time rules (that is, whether summer time exists, term, and hours shifted) of the date/time to be used and displayed in the electronic timepiece 1.

The host controller 40 stores the time-zone and the summer time rules calculated based on present position information calculated by the satellite radio wave receiving module 5 in the RAM 42 as local time setting information 421 (performs local time setting). The host controller 40 converts the present date/time kept by the timekeeping circuit 48 to local time of the present position according to the local time setting information 421. With this, the local time is utilized and displayed.

The oscillating circuit 46 generates a signal with a predetermined frequency and outputs the signal. The signal is generated using a crystal oscillator (oscillator). Such crystal oscillator can be externally attached to the microcomputer.

The frequency dividing circuit 47 outputs the frequency dividing signal dividing the frequency signal input from the oscillating circuit 46 at a set dividing ratio. The setting of the dividing ratio can be changed with the host CPU 41.

The timekeeping circuit 48 counts and holds the present date/time (at least the present time) by counting the frequency dividing signal with the predetermined frequency input from the frequency dividing circuit 47. The present date/time counted by the timekeeping circuit 48 can be corrected (controlled) with a control signal from the host CPU 41 based on the accurate present date/time calculated by a satellite radio wave receiving processor 50. The timekeeping circuit 48 can be hardware such as a counter, or the host CPU 41 can use software to count using the RAM 42.

The satellite radio wave receiving module 5 is a module which performs positioning operation by receiving the radio wave from the positioning satellite. The satellite radio wave receiving module 5 includes a satellite radio wave receiving processor 50, a DCXO 55 (digital control crystal oscillator) (first oscillator), a TCXO 56 (temperature compensating crystal oscillator) (second oscillator), a switch 57, and a ROM 58.

The satellite radio wave receiving processor 50 receives radio waves (satellite radio waves) transmitted from a positioning satellite of a satellite positioning system such as a GPS (Global Positioning System) of the US through the antenna A1. With this, the satellite radio wave receiving processor 50 calculates information such as date/time information (present date/time information) and positioning satellite position information (information including orbit information such as ephemeris, position information, speed information and acceleration speed information). The satellite radio wave receiving processor 50 performs positioning calculation to calculate the accurate present date/time and present position based on the above information. The satellite radio wave receiving processor 50 includes a receiver 51, a module controller 52 (positioning controller, computer), and a storage 53 (estimate information storage, position storage) and is formed as one as an LSI. The operation of the satellite radio wave receiving processor 50 is performed based on a clock signal with a predetermined frequency (for example, about 26 MHz) selectively input from the DCXO 55 or TCXO 56 through the switch 57.

The receiver 51 includes an acquiring unit 511 which performs an acquiring operation such as receiving and detecting the radio waves from the positioning satellite which is the reception target and identifying the positioning satellite and identifying the phase of the transmitting signal of the positioning satellite. The receiver 51 also includes a tracking unit 512 which tracks the acquired radio wave from the positioning satellite and continuously demodulates and calculates the signal. Regarding the operation of the receiver 51, the acquiring unit 511 and the tracking unit 512 are controlled separately. When operation is not necessary, the acquiring unit 511 and the tracking unit 512 can each be stopped.

The module controller 52 performs processes such as controlling reception of the satellite radio wave and identifying the present date/time and calculating the present position (that is, positioning calculation) based on the received signal (positioning information). The module controller 52 includes a module CPU 521 and a memory 522.

The module CPU 521 performs various calculating processes and controls the operation of the satellite radio wave receiving processor 50. The module CPU 521 (module controller 52) has higher computing processing than the host CPU 41 (host controller 40), and is able to perform high load processing such as the above-described positioning calculation. Due to the above, the power consumption of the module CPU 521 is larger than power consumption during standby and power consumption when processes similar to the above are performed in the host CPU 41. The module CPU 521 and the host CPU 41 are connected by a connection with high power consumption efficiency such as a I2C bus.

The memory 522 includes a volatile memory such as DRAM and SRAM providing a work memory space (includes cache memory) in the module CPU 521 and a ROM which stores initial setting data, etc. As the ROM, a non-volatile memory which can be rewritten and updated can be used in addition to or instead of the mask ROM.

In its own operation, the module controller 52 counts the date/time based on the date/time information kept by the timekeeping circuit 48 calculated from the host CPU 41. The satellite radio wave receiving module 5 includes an RTC (Real Time Clock) different from the microcomputer 4. Therefore, the module controller 52 is able to calculate the date/time from the RTC and count the date/time. The RTC counts the date/time using the clock signal with a predetermined frequency (for example, about 16 kHz) input from the oscillating circuit 46 or other oscillating circuit.

The storage 53 is an auxiliary storage which stores various setting data, history data and programs regardless of the electric power supply state. Such data includes, ephemeris (information regarding the present position of the positioning satellite) and almanac (estimate orbit information) data calculated from positioning satellites, most previous receiving timing data, and calculated present position history data. The storage 53 stores a correction table 531 according to the measurement value of a later-described thermistor 551 of the DCXO 55 and an acquiring table 532 (acquiring time estimate information) showing the relation between the parameter regarding the radio wave reception strength (for example, CNR) and the estimate information of the amount of time necessary for acquiring. For example, a flash memory is used as the storage 53.

Separate from the units regarding the operation of the timepiece such as the host CPU 41, the satellite radio wave receiving processor 50 is able to switch the electric power supply from the electric power supplying unit 70.

The DCXO 55 digitally controls and adjusts the oscillating frequency of the crystal oscillator and outputs a predetermined frequency signal (clock signal). The DCXO 55 includes a thermistor 551 and adjusts the oscillating frequency based on the temperature detected by the thermistor 551. The relation between the temperature measured by the thermistor 551 and the adjusting range of the oscillating frequency is held as table data in advance. The oscillating frequency of the DCXO 55 initially tends to become comparatively larger (±10 to 30 ppm, etc.) compared to TCXO 56 depending on the variation of the crystal oscillator. As the table data is successively updated based on the data regarding the relation with the temperature measured by the thermistor 551 calculated in use, the accuracy can be enhanced (±1 to 3 ppm, etc.). The adjustment control can be performed by the module controller 52 or any other structure as long as the process regarding enhancement of accuracy is possible. Here, the table data showing the relation is stored in the storage 53 as the correction table 531 and the module controller 52 performs the control process.

The TCXO 56 is a crystal oscillator including a temperature compensation function and a structure configured as a module can be used. The TCXO 56 compensates the oscillating frequency of the crystal oscillator which changes according to temperature and outputs a highly accurate clock signal which has a smaller frequency variation from the set frequency than the DCXO 55, that is, a high frequency stability. Within the normal reception handling temperature range, the TCXO 56 is able to stably output the signal with a sampling frequency suitable according to the inverse spectrum spread (normally, ±1 ppm or lower, 0.1 ppm, etc.). The TCXO 56 internally includes a temperature compensation circuit, and supplies electric power for operation when the temperature compensation circuit operates so that the power consumption becomes larger than the DCXO 55.

The clock frequency which is the target of output by the DCXO 55 and the TCXO 56 are the same.

The switch 57 includes a switching unit which alternately switches the supply source of the clock signal between the DCXO 55 and the TCXO 56 under the control of the module controller 52. The switch 57 is also able to stop the operation of the DCXO 55 or the TCXO 56 which is not the supply source of the clock signal. Alternatively, the switching between operating and not operating can be directly performed by the module controller 52.

The ROM 58 is a storage which stores the program 581 and the setting data 582 to execute various operations performed by the host CPU 41 and the module CPU 521. Other than the mask ROM, the ROM 58 may include a nonvolatile memory such as a flash memory in which data can be rewritten and updated. The setting data 582 stored in the ROM 58 includes map data to calculate the time-zone in which the present position belongs, and the summer time setting. The host CPU 41 can directly access to the data of the ROM 58.

The operation member 61 receives input from external operation such as user operation. For example, the operation member 61 includes one or a plurality of press button switches and outputs the signal according to the pressed press button switch to the host CPU 41.

The display 62 displays various types of information under control by the host CPU 41. The display 62 includes a display screen and a driving circuit. For example, a Liquid Crystal Display (LCD) is used as the display screen, and the driving circuit performs the driving operation regarding the display on the liquid crystal display screen. The contents displayed on the display 62 include information regarding present date/time (at least time) and position information according to the positioning result.

The annunciator 63 performs various notifying operations to the user. Mechanisms to generate notification include a speaker, a piezoelectric element which generates a beeping sound, a vibrating motor or the like.

The electric power supplying unit 70 supplies to each unit electric power necessary to operate each unit of the electronic timepiece 1. The electric power supplying unit 70 supplies the electric power output from a battery 71 at an operation voltage for each unit. When the operation voltage is different depending on the operating site, the electric power supplying unit 70 converts the voltage using a regulator and outputs the voltage. For example, the battery 71 includes a solar panel which generates power depending on the entering light and a secondary cell which accumulates generated electric power. Alternatively, a detachable dry cell or rechargeable cell is stored in a storing unit and is used as the battery 71.

Next, the positioning operation is described.

According to the satellite positioning performed by receiving the radio wave from the positioning satellite, radio waves are received from 3 or more positioning satellites (three-dimensionally 4 satellites; predetermined number necessary for calculating present position). The reception position is calculated with the present position of the plurality of positioning satellites and the shift in receiving timing of the radio waves (pseudo range). Here, the measurement of the shift amount of the receiving timing greatly depends on the accuracy of the supplied clock signal.

For example, the positioning satellite (GPS satellite) according to GPS (Global Positioning System) of the US is mainly used as the positioning satellite, but positioning satellites of other positioning system such as GLONASS of Russia can be used. Alternatively, the positioning satellites of a plurality of positioning systems can be used in combination to perform positioning. The signal transmitted from the positioning satellite includes the present date/time information and the information regarding the satellite position. The information is transmitted by spectrum spread in a format determined in the positioning system. The acquiring unit 511 uses code string data of a spread code (C/A code) of the positioning satellites held in advance and detects the signal with inverse spectrum spread. The C/A code is a pseudo random code string in which 1023 codes (chips) are arranged and is repeated at 1023 kHz (1 msec cycle).

Figure 2:
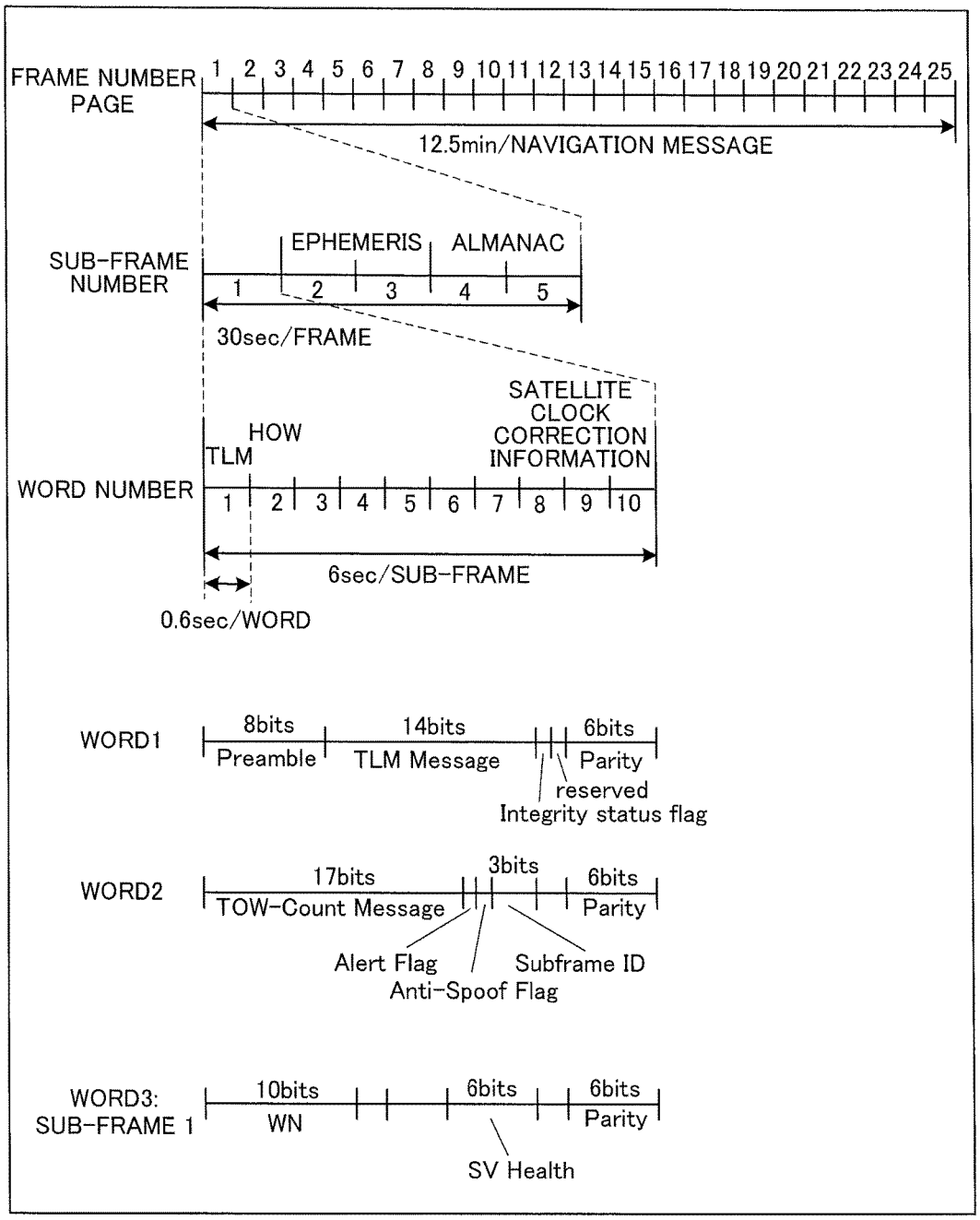
FIG. 2 is a diagram describing a format of a navigation message of a signal transmitted by a radio wave transmitted from a GPS satellite.

FIG. 2 is a diagram describing a format of a navigation message in a signal transmitted by the radio wave transmitted from the GPS satellite.

According to GPS, frame data in the unit of 30 seconds is transmitted from each GPS satellite to be a total of 25 pages, and with this, all data is output in a cycle of 12.5 minutes. Each frame data includes 5 sub-frames (6 seconds). Each sub-frame includes 10 words (0.6 seconds each, in order, WORD 1 to WORD 10). The data format of WORD 1 and WORD 2 is the same in all sub-frames. In WORD 1, after the Preamble which is a fixed code string of 8 bits (predetermined code string), a telemetry (TLM Message) of 14 bits is transmitted, then an Integrity status flag of 1 bit, 1 spare bit, and parity data of 6 bits are provided. The WORD 2 is shown with TOW-Count (also called Z-count) of 17 bits and then an Alert flag and an Anti-spoof flag each with 1 bit. Then, a sub-frame ID showing a sub-frame number (cycle number) of 3 bits is shown and 2 bits for matching the parity data and parity data of 6 bits are provided.

The data of WORD 3 and after is different depending on the sub-frame. In sub-frame 1, WN (week number) of 10 bits and satellite health information (SV-Health) are included in WORD 3, and satellite clock correction information is included in WORD 8 to WORD 10. The sub-frames 2 and 3 mainly include ephemeris (orbit information) and a part of the sub-frame 4, and the sub-frame 5 include almanac (estimate orbit information).

According to the GPS satellite and a Quasi-Zenith Satellite System (QZSS) of Japan conforming to the GPS satellite, the preamble transmitted once every 6 seconds is to be the reference code string and identification of the code string (securing of synchronizing) and decoding is performed. The ephemeris transmitted at a 30 second cycle is normally valid for 4 hours, and a valid ephemeris updated before the valid term ends needs to be calculated again.

According to the GLONASS satellite, the information of the position, speed, and acceleration speed (ephemeris) is transmitted once every 30 seconds and updated every predetermined time period (30 minutes). Therefore, a new (valid) ephemeris is calculated at every update.

The almanac transmits information of all positioning satellites with 12.5 minute cycles in the GPS satellite and 2.5 minute cycles in the GLONASS satellite with signals from the positioning satellites. The almanac can be calculated when the radio wave is received from any of the positioning satellites.

When the ephemeris is calculated and held, the present position can be calculated based on the present date/time and the shift of the receiving timing of the radio wave from each acquired positioning satellite. In the electronic timepiece 1, the present position is calculated and output at a predetermined time interval. The predetermined time interval may be constant, such as every 5 seconds or every minute. Alternatively, the electronic timepiece 1 can include a measuring unit including an acceleration speed sensor or terrestrial magnetism sensor (both not shown), and the moving state can be measured and determined to suitably set and change a time interval according to the moving speed.

Next, the positioning control operation in the electronic timepiece 1 is described.

The electronic timepiece 1 is able to perform positioning operation by the satellite radio wave receiving processor 50 at a predetermined time interval and is able to calculate position data (history data). Here, in the electronic timepiece 1, either the TCXO 56 or the DCXO 55 is selected as the supply source of the clock signal during operation of the satellite radio wave receiving processor 50, and the oscillator selected according to the switching operation by the switch 57 under the control (switching control) of the module controller 52 outputs the clock signal. As described above, the accuracy of the signal (positive value and stability) is higher in the TCXO 56. Therefore, normally, according to the reception status of the radio wave, the TCXO 56 is used when the apparatus is started or when the reception status is bad, that is, when the radio wave reception strength is low and/or when the position of the acquired positioning satellite is not preferable. When it is possible to calculate position information at an accuracy equal to or more than the reference from a sufficient number of positioning satellites (suitable satellite position) the DCXO 55 is used.

When the necessary position accuracy is different depending on the state of use, etc., the accuracy which is to be the reference for switching between the TCXO 56 and the DCXO 55 can be changed.

Figure 3:
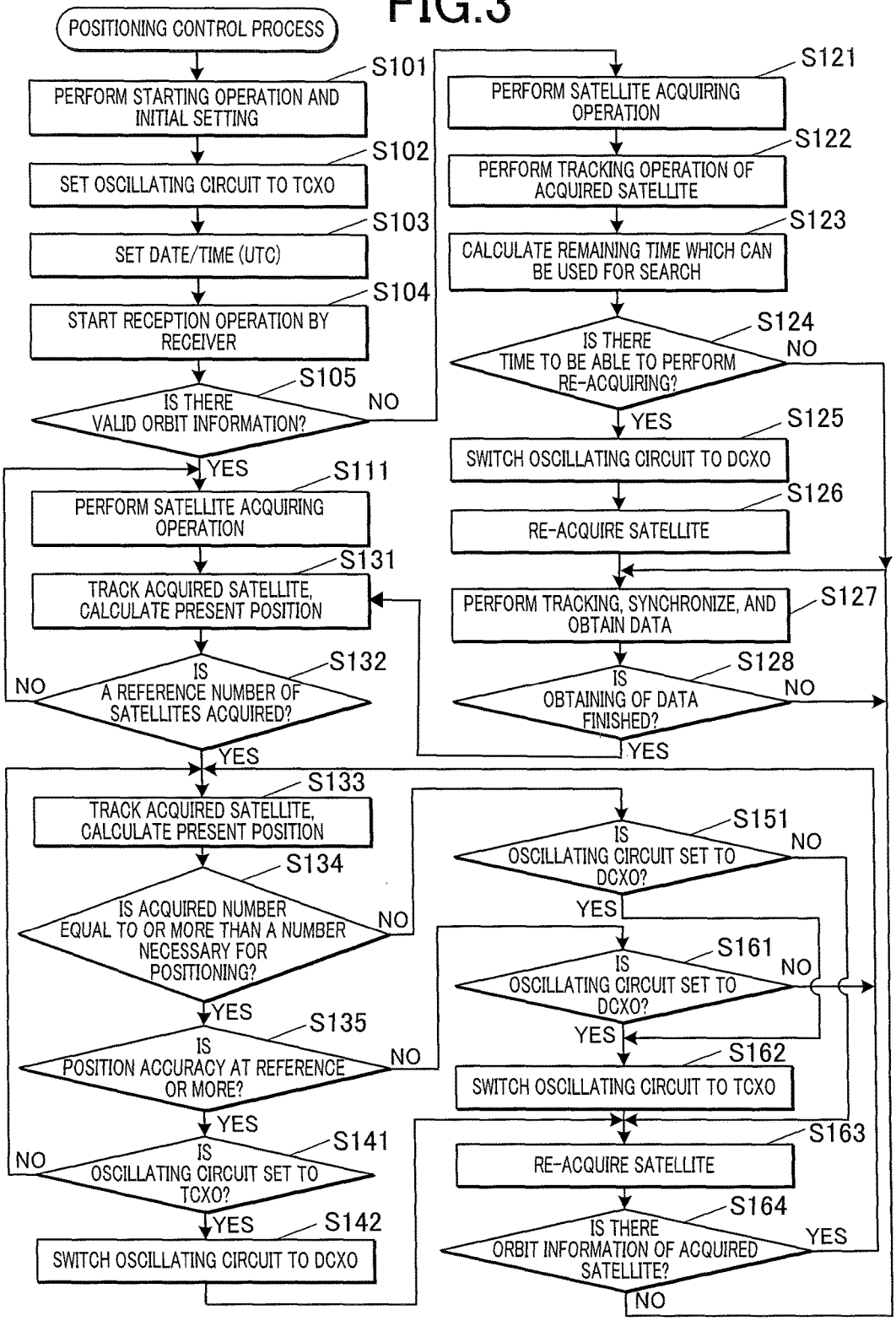
FIG. 3 is a flowchart showing a control procedure of a positioning control process.

FIG. 3 is a flowchart showing a control procedure by the module controller 52 of the positioning control process performed by the satellite radio wave receiving module 5 according to the present embodiment.

The positioning control process starts when started by the host controller 40 and calculated by the positioning instruction, and the process continues until the positioning end instruction is received by interruption through the host computer 40 due to input on the operation member 61 or the like.

When the positioning control process starts, the module controller 52 (module CPU 521) performs the start operation and the initial setting of the satellite radio wave receiving processor 50 (step S101). The module controller 52 considers the setting of the switch 57 as the input from the TCXO 56 (step S102).

The module controller 52 sets the UTC date/time based on the present date/time input from the host controller 40 (step S103). The module controller 52 starts the reception operation of the satellite radio wave by the receiver 51 (step S104).

The module controller 52 determines whether the ephemeris data (information regarding present position of the positioning satellite) within the valid term is stored in the storage 53 for the set UTC date/time (step S105). When it is determined that it is stored ("YES" in step S105), the module controller 52 controls the acquiring unit 511 to perform acquiring operation of the radio wave from the positioning satellite (step S111). Here, the module controller 52 calculates the positioning satellite predicted to be a visible state at the present based on the ephemeris or the almanac. With this, it is possible to acquire the radio wave from the above positioning satellite with priority. The process of the module controller 52 advances to step S131.

When it is determined that the valid ephemeris data is not stored (step S105, "NO"), the module controller 52 controls the acquiring unit 511 to perform the acquiring operation of the radio wave from all positioning satellites (step S121). When the almanac is held, the positioning satellite predicted to be in the visible state at present is calculated based on the almanac, and the radio wave from such positioning satellite can be acquired with priority. The module controller 52 starts the tracking operation of the radio wave from the acquired positioning apparatus performed sequentially by the tracking unit 512 (step S122). The module controller 52 calculates the remaining time (estimated time) that the acquiring operation can be continued until the timing that it is assumed that the preamble is received based on the present date/time (step S123). Here, the module controller 52 considers the maximum shift range of the date/time calculated with the date/time information or estimated based on the previous date/time calculating history, etc. and calculates the minimum remaining time (minimum time). That is, when the error of the date/time counted by the timekeeping circuit 48 is ±0.5 seconds or less for each day, the maximum shift range is the time (seconds) multiplying 0.5 to the passed number of days (passed time) from the previous date/time calculating timing.

The module controller 52 determines the remaining time that the acquiring can be performed again when the oscillating circuit is switched to DCXO 55 (step S124). The module controller 52 refers to the acquiring table 532 stored in the storage 53, calculates the time (re-acquiring time) estimated to be necessary for acquiring with the DCXO 55 corresponding to the reception strength of the radio wave from the acquired positioning satellite (including index of the radio wave strength relative to the noise of the CNR, etc.), and compares the time with the remaining time. For example, the table shows actual values calculated in advance by examinations, and when the reception strength becomes lower than a predetermined level, the time necessary for acquiring drastically increases. When it is determined that there is no remaining time necessary for re-acquiring (no re-acquiring time) (step S124, "NO"), the process of the module controller 52 advances to step S127. When it is determined that there is remaining time necessary for re-acquiring (there is re-acquiring time) (step S124, "YES"), the module controller 52 switches the oscillating circuit which supplies the clock signal to the switch 57 to the DCXO 55 (step S125). Then, the module controller 52 performs the acquiring operation again (step S126). Then, the process of the module controller 52 advances to step S127.

When the process advances to step S127, the module controller 52 controls the tracking unit 512 to track the radio wave from the acquired positioning satellite and demodulates the signal to identify the preamble. The module controller 52 decodes and deciphers the signal as the reference of the position of the identified preamble and calculates the date/time information and ephemeris data (step S127).

The module controller 52 determines whether calculating the necessary date/time information and ephemeris data is finished (step S128). When it is determined that the calculating is not finished (step S128, "NO"), the process of the module controller 52 returns to step S127. When it is determined that the calculating is finished, the process of the module controller 52 advances to step S131.

When the process advances to step S131, the module controller 52 calculates the present position at a predetermined time interval while performing the tracking operation of the acquired satellite (step S131). The module controller 52 stores the calculated present position as the history data with the present date/time in the storage 53. The module controller 52 outputs the control signal to the display 62 and displays the present position on the display 62. The module controller 52 determines whether the radio waves from the positioning satellites in a reference number or more are acquired (step S132). The reference number here is the number of satellites necessary for positioning, that is, usually more than 3 or 4 satellites, and a number of satellites so that sufficient accuracy is maintained and in which positioning can be continued even if some of the radio waves from the acquired positioning satellites fall out of the acquired state, for example, 6 to 8 satellites. When it is determined that this is not acquired (step S132, "NO"), the process of the module controller 52 returns to step S111 and the acquiring operation by the acquiring unit 511 is continued or restarted.

When it is determined that the radio waves from the positioning satellites in a number of the reference number or more are acquired (step S132, "YES"), the module controller 52 ends the acquiring operation by the acquiring unit 511 and performs calculating of the present position in a predetermined time interval while continuing the tracking operation by the tracking unit 512 (step S133).

The module controller 52 determines whether the tracking is continued in a state in which the radio waves from the positioning satellites in a number equal to or larger than the number necessary for positioning is acquired (step S134). Here, the module controller 52 also determines whether the ephemeris of the positioning satellite regarding the acquired radio wave is within the valid term. Here, the valid term of the ephemeris can be set to a shorter time (for example, 2 hours) than the above-described valid term of the ephemeris (4 hours). When it is determined that the radio waves are not acquired from the positioning satellites in a number equal to or larger than the number necessary for positioning (even if acquired, the ephemeris is not within the valid term) (step S134, "NO"), the module controller 52 determines whether the supply source of the clock signal is the DCXO 55 (step S151). When it is determined that it is the DCXO 55 (step S151, "YES"), the module controller 52 advances the process to step S162 and controls the switching unit 57 to switch the supply source to TCXO 56 (step S162). Then, the process of the module controller 52 advances to step S163. When it is determined that it is not the DCXO 55 (step S151, "NO"), the process of the module controller 52 advances to step S163.

When it is determined that the radio waves are acquired from the positioning satellites in a number equal to or more than the number necessary for positioning (step S134, "YES"), the module controller 52 determines whether the calculated position accuracy is a reference or more (step S135). For example, DOP (Dilution of Precision) is used as the index of the position accuracy. When it is determined that it is not the reference or more (step S135, "NO"), the module controller 52 determines whether the supply source of the clock signal is the DCXO 55 (step S161). When it is determined that it is the DCXO 55 (step S161, "YES"), the module controller 52 controls the switch 57 to switch the supply source to the TCXO 56 (step S162). Then, the process advances to step S163. When it is determined that it is not the DCXO 55 (step 161, "NO"), the process of the module controller 52 returns to step S133.

When it is determined that the calculated position accuracy is a reference or more (step S135, "YES"), the module controller 52 determines whether the supply source of the clock signal is the TCXO 56 (step S141). When it is determined that it is the TCXO 56 (step S141, "YES"), the module controller 52 controls the switch 57 to switch the supply source to the DCXO 55 (step S142). Then, the process of the module controller 52 advances to step S163. When it is determined that it is not the TCXO 56 (step S141, "NO"), the process of the module controller 52 returns to step S133.

When the process advances from the process in steps S142, S151, and S162 to step S163, the module controller 52 controls the acquiring unit 511 to perform the acquiring operation of the radio waves from the positioning satellite again (step S163). In this case, the module controller 52 can omit the radio waves of the presently acquired positioning satellite from the target of re-acquiring. The radio waves of the acquired positioning satellite include the phase shift of the clock signal being small and not falling outside the acquiring when the supply source of the clock signal is switched (mainly, switching to the more accurate TCXO 56, but not limited to this). The module controller 52 determines whether the valid ephemeris is held for the positioning satellite transmitting the acquired radio waves (step S164). When it is determined that it is not held (step S164, "NO"), the process of the module controller 52 advances to step S127. When it is determined that it is held (step S164, "YES"), the process of the module controller 52 returns to step S133.

Among the above processes, steps S131 and S133 are included in the position identifying step (position identifying unit). Steps S125, S142, and S162 are included in the clock switching step (clock switching unit).

As described above, the satellite radio wave receiving module 5 according to the present embodiment includes, a DCXO 55 which outputs the clock signal, a TCXO 56 which outputs a clock signal more accurate than the DCXO 55, a receiver 51 which receives a radio wave from a positioning satellite, and a module controller 52 which calculates a present position based on positioning information calculated from a received radio wave, wherein, the module controller 52 controls switching a supply source of the clock signal to the receiver 51 and the module controller 52 between the DCXO 55 or the TCXO 56 depending on a receiving state of a radio wave from a positioning satellite by a receiver 51.

As described above, since power consumption of oscillators greatly differ depending on the accuracy, two types of oscillators with high and low accuracy (power consumption) are provided. With this, the power consumption can be reduced while maintaining the reception accuracy necessary for positioning according to receiving status. Therefore, positioning can be performed more efficiently.

The module controller 52 controls the switching according to accuracy of the calculated present position. That is, the module controller 52 switches the supply source of the clock signal between the DCXO 55 and the TCXO 56 according to whether the acquired positioning satellite used in calculating the present position is suitably positioned in a scattered state. With this, the accuracy of the clock signal is not forcibly reduced and the calculation of the present position is not made difficult. On the other hand, when it is determined that there will be no problems in calculating the present position even if the accuracy of the clock signal is decreased, the accuracy of the clock signal is suitably decreased so that the power consumption can be decreased.

The module controller 52 controls the receiver 51 to perform acquiring operation of the radio wave from the positioning satellite in a state receiving supply of the clock signal from the TCXO 56. When the positioning satellite is acquired in a number which is a number of satellites necessary for calculating the present position, the module controller 52 determines whether the acquiring operation can be performed again within an estimated time until the preamble can be detected in the demodulated signal from the acquired radio wave. When it is determined that the acquiring operation can be performed again, the supply source of the clock signal is switched to the DCXO 55, and the receiver 51 performs the acquiring operation again. As described above, at the start of receiving, when there is plenty of time for processing, the supply source of the clock signal is switched to the DCXO 55 when it is possible during such time period. Therefore, it is possible to efficiently select the suitable clock signal and start positioning without unnecessary extension of receiving time.

The module controller 52 considers the reception strength of the acquired radio wave and calculates the re-acquiring time necessary to perform acquiring operation again from the acquiring table 532. Then, the module controller 52 determines whether acquiring can be performed again. As described above, the switching to the DCXO 55 is performed only when it is possible to perform switching without difficulty within an assumption based on the actual reception strength that the acquiring can be performed again. Therefore, the time for acquiring operation and the time for calculating the present position after acquiring is not extended more than necessary.

The storage 53 stores the acquiring table 532 showing the relation between the reception strength of the radio wave from the positioning satellite (including relative strength index of the noise such as CNR) and re-acquiring time. With this, the time necessary for acquiring can be easily estimated and suitable process timing can be controlled. The acquiring table 532 can be stored and updated in a flash memory, etc. With this, the accuracy can be enhanced according to the actual measurements.

The module controller 52 calculates the shortest estimated time based on the maximum shift range assumed in the estimated time. That is, error occurs in the estimated time according to the date/time counted in the timekeeping circuit 48. Therefore, by considering such error and estimating the estimating time to be short, it is possible to prevent the receiving timing of the preamble passing while acquiring is performed. With this, it is possible to prevent unnecessary prolonging of the time necessary to finish calculating the ephemeris data and positioning can be started without delay.

The module controller 52 assumes the maximum shift range based on the passed time from the timing that the previous positioning is performed. The date/time which is counted by the timekeeping circuit 48 can be corrected with the accurate date/time calculated at positioning. The shift later on may increase according to the maximum error determined in the oscillating circuit 46. Therefore, by considering the maximum shift range caused by the maximum error, it is possible to prevent wasting time on unsuccessful detecting of the preamble or calculating of the date/time due to the unexpected shift.

The storage 53 stores the information (ephemeris) regarding the present position of the positioning satellite. When a valid (within the valid term) ephemeris is held, the module controller 52 starts reception of the receiver 51 in a state receiving supply of the clock signal from the TCXO 56, and performs positioning calculating. That is, when the positioning can be performed soon after acquiring the radio wave from the satellite, instead of forcibly decreasing the accuracy, priority is placed on performing the positioning. With this, the user-friendliness is not decreased.

Since the temperature compensation crystal oscillator (TCXO) is used as the highly accurate oscillator, temperature change which provides a large influence to the variation of the oscillating frequency is suitably compensated, and positioning can be performed securely even in a situation with bad reception.

The digital control crystal oscillator (DCXO) is used as the oscillator with an accuracy lower than the TCXO 56. Therefore, with the lowest level accuracy of the crystal oscillator and the circuit configuration which can suitably control the measuring value of the thermistor 551, the positioning can be maintained at a low power consumption within a suitable range of good reception status while suppressing increase of the cost and size.

The electronic timepiece 1 according to the present embodiment includes the above-described satellite radio wave receiving module 5, a timekeeping circuit 48 which counts the present date/time, and a display 62 which displays the time according to the present date/time.

As described above, according to the electronic timepiece 1, the present position can be calculated while suppressing the power consumption.

The electronic timepiece 1 includes a host controller 40 which performs local time setting according to the present position based on the information of the present position identified by the operation of the satellite radio wave receiving module 5. With this, the user is able to understand the accurate local time according to the present position easily and suitably by utilizing the positioning process. That is, the user is free from the troublesome burden of setting the local time.

The DCXO 55 and the TCXO 56 are used to perform the positioning operation by the above-described positioning control method. With this, the operation can be performed efficiently and the power can be suitably consumed while maintaining quick calculating of the present position within a suitable accuracy.

The program 581 to control the above-described positioning control process is installed and the module CPU 521 (module controller 52) executes the process with software. With this, the process to easily and suitably calculate the present position can be performed efficiently.

The present invention is not limited to the above-described embodiment, and various changes can be made.

For example, the present embodiment includes the DCXO 55 and the TCXO 56 as the oscillating circuit. Alternatively, an OCXO (oven controlled crystal oscillator) can be used as an oscillator with higher accuracy. The DCXO 55 does not need to be digitally controlled, and a normal VCXO (voltage controller crystal oscillator) can be controlled by voltage based on the measured temperature of the thermistor 551. If the minimum accuracy and stability necessary for receiving the radio wave from the positioning satellite can be secured, instead of using crystal oscillators, oscillators using ceramic oscillators or oscillators using Si (silicon) based MEMS (Micro Electro Mechanical Systems) oscillators can be used.

According to the above-described embodiment, when the number of acquired satellites decreases and is insufficient, re-acquiring is always performed by switching to transmission of clock signals from TCXO 56, however, when the reception situation is good, it is not always necessary to switch to the TCXO 56. Moreover, when re-acquiring can be performed by receiving supply of the clock signal from the DCXO 55, re-acquiring can be performed when there is sufficient number of acquired satellites, that is, 4 or 5 satellites.

According to the present embodiment, the shift range of the detecting timing of the preamble is estimated by the passing time from the previous positioning timing. In addition to the above, temperature history within the passed time can also be considered. When the shift range is large (6 seconds or more) compared to the transmitting frequency (once every 6 seconds) of the preamble, a constant value (for example, 3 seconds) can be set, or the value can be set to 0 seconds and switching to the DCXO 55 is not performed at this time.

According to the above-described embodiment, the preamble is detected to be the reference position of the code string, but the code string showing the value of the TOW-Count according to the present date/time can be detected.

According to the present embodiment, the ephemeris is received and calculated, but when the ephemeris can be calculated through communication units, the decoding and calculating of the ephemeris based on the radio wave received from the positioning satellite does not have to be performed. In this case, the ephemeris can be stored in the ROM 58 (non-volatile memory). Other information such as the correction table 531 and the acquiring table 532 can be stored in the ROM 58 accessible from the host controller 40.

According to the above-described embodiment, the electronic timepiece 1 is a watch, but the electronic timepiece 1 can be in any form. For example, the electronic timepiece 1 can be a portable clock, a small clock placed and attached inside a vehicle or the like.

The satellite radio wave receiving module 5 is not limited to those provided in the electronic timepiece 1. The satellite radio wave receiving module 5 can be used as a dedicated positioning apparatus with a display or operation member. The satellite radio wave receiving module 5 can also be provided in other apparatuses such as an activity monitor which measures the number of steps of the user and calories consumed by the user, a pulse monitor, a sphygmomanometer, or the like. In these cases, the host CPU 41 and the timekeeping circuit 48 do not have to be provided separately, and the module CPU 521 can perform unitary calculation control. When the satellite radio wave receiving module 5 is started, the date-time information is calculated from the above-described RTC. When the satellite radio wave receiving module 5 is stopped or positioning ends, the date/time of the RTC is corrected to a correct date/time based on the positioning result.

According to the above description, the ROM 58 which may include a non-volatile memory is provided as an example as the computer readable medium including the program 581 for the operation process such as the positioning control process regarding the process by the module controller 52. Alternatively, other computer readable mediums may be employed, such as a HDD (Hard Disk Drive) or a portable recording medium such as a CD-ROM or DVD disk. As a medium providing data of the program of the present invention through communication wires, a carrier wave can be applied to the present invention.

The detailed description of the configuration, control contents and process shown in the present embodiment can be suitably changed without leaving the scope of the present invention.

The embodiments of the present invention are described above, but the scope of the present invention is not limited to the above-described embodiment. The scope of the present invention is limited to the invention as claimed and its equivalents.

This application is based upon and claims the benefit of priority from Japanese Patent Application No. 2016-180148 filed on Sep. 15, 2016 the entire contents of which are incorporated herein by reference.

What is claimed is:

1. A positioning apparatus comprising:

a first oscillator configured to output a first clock signal;

a second oscillator configured to output a second clock signal, wherein the second clock signal is more accurate than the first clock signal;

a receiver configured to receive at least one radio wave from at least one positioning satellite using one of the first clock signal and the second clock signal; and a positioning controller configured to:

calculate positioning information from the at least one radio wave received using the one of the first clock signal and the second clock signal;

calculate a present position from the positioning information;

determine whether a reception status of the at least one radio wave received by the receiver using the one of the first clock signal and the second clock signal is at a predetermined level or higher;

in response to determining that the reception status is at the predetermined level or higher:

control the receiver to receive the at least one radio wave; and calculate the positioning information from the at least one radio wave received, using the first clock signal; and in response to determining that the reception status is below the predetermined level:

control the receiver to receive the at least one radio wave; and calculate the positioning information from the at least one radio wave received, using the second clock signal which is more accurate than the first clock signal.

2. The positioning apparatus of claim 1, wherein the positioning controller is configured to:

determine that the reception status of the radio wave received by the receiver using the one of the first clock signal and the second clock signal is at the predetermined level or higher by determining that accuracy of the present position calculated is equal to or more than a predetermined reference, and determine that the reception status of the radio wave received by the receiver using the one of the first clock signal and the second clock signal is below the predetermined level by determining that the accuracy of the present position calculated is less than a predetermined reference.

3. The positioning apparatus of claim 2, wherein the positioning controller is configured to:

control the receiver to receive the at least one radio wave from the at least one positioning satellite using the second clock signal;

determine whether receiving the at least one radio wave from the at least one positioning satellite can be performed again within an estimated time until a predetermined code string is detected in a signal demodulated from the at least one radio wave acquired again; and in response to determining that acquiring the at least one radio wave from the at least one positioning satellite can be performed again:

control the receiver to receive the at least one radio wave from the at least one positioning satellite again; and calculate the positioning information from the at least one radio wave received again, using the first clock signal.

4. The positioning apparatus of claim 3, wherein the positioning controller is configured to:

determine a reception strength of the at least one radio wave acquired from the at least one positioning satellite as the reception status of the at least one radio wave acquired from the at least one positioning satellite; and calculate re-acquiring time necessary for acquiring the at least one radio wave from the at least one positioning satellite again based on the reception strength determined.

5. The positioning apparatus of claim 4, wherein the positioning controller is configured to:

retrieve, from an estimate information storage, acquiring time estimate information on a relation between the reception strength determined and the re-acquiring time; and calculate the re-acquiring time based on the acquiring time estimate information.

6. The positioning apparatus of claim 4, wherein the positioning controller is configured to calculate minimum estimated time based on a maximum shift range assumed in the estimated time.

7. The positioning apparatus of claim 6, wherein the positioning controller is configured to determine the maximum shift range based on an amount of time which passed from timing when calculation of the present position was previously is performed.

8. The positioning apparatus of claim 3, wherein the positioning controller is configured to calculate minimum estimated time based on a maximum shift range assumed in the estimated time.

9. The positioning apparatus of claim 8, wherein the positioning controller is configured to determine the maximum shift range based on an amount of time which passed from timing when calculation of the present position was previously performed.

10. The positioning apparatus of claim 1, wherein the positioning controller is configured to:

control the receiver to receive the at least one radio wave from the at least one positioning satellite using the second clock signal;

determine whether receiving the at least one radio wave from the at least one positioning satellite can be performed again within an estimated time until a predetermined code string is detected in a signal demodulated from the at least one radio wave acquired again; and in response to determining that acquiring the at least one radio wave from the at least one positioning satellite can be performed again:

control the receiver to receive the at least one radio wave from the at least one positioning satellite again; and calculate the positioning information from the at least one radio wave received again, using the first clock signal.

11. The positioning apparatus of claim 10, wherein the positioning controller is configured to calculate minimum estimated time based on a maximum shift range assumed in the estimated time.

12. The positioning apparatus of claim 11, wherein the positioning controller is configured to determine the maximum shift range based on an amount of time which passed from timing when calculation of the present position was previously is performed.

13. The positioning apparatus of claim 10, wherein the positioning controller is configured to:

retrieve, from a position storage, information regarding present satellite position of the at least one positioning satellite;

determine whether the information regarding the present satellite position is valid; and in response to determining that the information regarding the present satellite position is valid:

control the receiver to start receiving the at least one radio wave; and calculate the positioning information from the at least one radio wave received, using the second clock signal which is more accurate than the first clock signal.

14. The positioning apparatus of claim 1, wherein the positioning controller is configured to:

retrieve, from a position storage, information regarding present satellite position of the at least one positioning satellite;

determine whether the information regarding the present satellite position is valid; and in response to determining that the information regarding the present satellite position is valid:

control the receiver to start receiving the at least one radio wave; and calculate the positioning information from the at least one radio wave received, using the second clock signal which is more accurate than the first clock signal.

15. The positioning apparatus of claim 1, wherein the second oscillator comprises a temperature compensation crystal oscillator.

16. The positioning apparatus of claim 1, wherein the first oscillator comprises a digital control crystal oscillator.

17. An electronic timepiece comprising:

the positioning apparatus according to claim 1;

a timekeeping circuit configured to count present time; and a display configured to display time according to the present time.

18. The electronic timepiece of claim 17, further comprising a timekeeping controller configured to convert the present time counted by the timekeeping circuit to local time based on the present position calculated by the positioning controller of the positioning apparatus.

19. A method used in a positioning apparatus comprising: a first oscillator configured to output a first clock signal; a second oscillator configured to output a second clock signal, wherein the second clock signal is more accurate than the first clock signal; and a receiver configured to receive at least one radio wave from at least one of the first clock signal and the second clock signal, the method comprising:

calculating positioning information from the radio waves received using the one of the first clock signal and the second clock signal;

calculating a present position from the positioning information;

determining whether a reception status of the at least one radio wave received by the receiver using the one of the first clock signal and the second clock signal is at a predetermined level or higher;

in response to determining that the reception status is at the predetermined level or higher:

controlling the receiver to receive the at least one radio wave; and calculating the positioning information from the at least one radio wave received, using the first clock signal; and in response to determining that the reception status is below the predetermined level:

controlling the receiver to receive the at least one radio wave; and calculating the positioning information from the at least one radio wave received, using the second clock signal which is more accurate than the first clock signal.

20. A non-transitory computer-readable storage medium having a program stored thereon for controlling a computer used in a positioning apparatus comprising: a first oscillator configured to output a first clock signal; a second oscillator configured to output a second clock signal, wherein the second clock signal is more accurate than the first clock signal; and a receiver configured to receive at least one radio wave from at least one positioning satellite using one of the first clock signal and the second clock signal;

wherein the program controls the computer to at least perform the functions of:

calculating positioning information from the at least one radio wave received using the one of the first clock signal and the second clock signal;

calculating a present position from the positioning information;

determining whether a reception status of the at least one radio wave received by the receiver using the one of the first clock signal and the second clock signal is at a predetermined level or higher;

in response to determining that the reception status is at the predetermined level or higher:

controlling the receiver to receive the at least one radio wave; and calculating the positioning information from the at least one radio wave received, using the first clock signal; and in response to determining that the reception status is below the predetermined level:

controlling the receiver to receive the at least one radio wave; and calculating the positioning information from the at least one radio wave received, using the second clock signal which is more accurate than the first clock signal.

* * * * *